US005484245A

United States Patent [19]

Zopf

[11] Patent Number: 5,484,245

[45] Date of Patent: Jan. 16, 1996

[54] MOTOR POWERED INTERMEDIATE CONTAINER AND METHOD OF USE

[75] Inventor: William D. Zopf, Chattanooga, Tenn.

[73] Assignee: Heil, Chattanooga, Tenn.

[21] Appl. No.: 189,406

[22] Filed: Jan. 31, 1994

Related U.S. Application Data

[63] Continuation of Ser. No. 877,488, May 1, 1992, abandoned.

[51] Int. Cl.[6] ..... B65F 3/04

[52] U.S. Cl. ..... 414/408; 414/406; 414/501; 414/555

[58] Field of Search ..... 414/406, 408, 414/409, 422, 501, 549, 551–555, 740–741

[56] References Cited

U.S. PATENT DOCUMENTS

| | | | |
|---|---|---|---|
| 3,136,436 | 6/1964 | Erlinder et al. | 414/409 |
| 3,576,265 | 4/1971 | Brady | 414/408 X |
| 3,762,586 | 10/1973 | Updike, Jr. | 414/408 |
| 3,822,802 | 7/1974 | Evans, Jr. | 414/501 |
| 4,042,137 | 8/1977 | Hughes et al. | 414/409 X |
| 4,363,588 | 12/1982 | Stickney | 414/408 |
| 4,543,028 | 9/1985 | Bell et al. | 414/408 |
| 4,722,658 | 2/1988 | Würtz et al. | 414/408 |
| 4,936,732 | 6/1990 | Naab et al. | 414/408 |
| 4,983,092 | 1/1991 | Richards | 414/408 |
| 5,266,000 | 11/1993 | LeBlanc et al. | 414/408 |
| 5,333,984 | 8/1994 | Bayne et al. | 414/408 |

FOREIGN PATENT DOCUMENTS

| | | | |
|---|---|---|---|
| 0405428 | 1/1991 | European Pat. Off. | 414/408 |
| 1531763 | 1/1970 | Germany | 414/408 |

*Primary Examiner*—Michael S. Huppert
*Assistant Examiner*—James W. Keenan
*Attorney, Agent, or Firm*—Parsons & Associates; Don J. Flickinger; Robert A. Parsons

[57] ABSTRACT

An intermediate container which may be attached to a lift assembly of a refuse collection vehicle, and having a side arm assembly attached thereto for emptying refuse containers. The side arm assembly includes an extendable arm coupled to the intermediate container, terminating in a tilt assembly and a grabber assembly. The grabber assembly engages a refuse container, which is drawn to the intermediate container where the tilt assembly empties the refuse container.

9 Claims, 6 Drawing Sheets

MOTOR POWERED INTERMEDIATE CONTAINER AND METHOD OF USE

This application is a continuation of application Ser. No. 07/877,488, filed May 1, 1992, now abandoned.

BACKGROUND OF THE INVENTION

1. Field of the Invention

This invention relates to refuse collection devices.

More particularly, the present invention relates to refuse vehicles utilizing motor powered systems for dumping containers.

In a further more specific aspect, the instant invention concerns a sidearm assembly on an intermediate container for a front end loading refuse vehicle 2. Prior Art The disposal of refuse has always been a problem in populated areas. This problem has increased with the filling and closure of land fills. Generally, refuse collected by individual households are stored in a relatively small can or refuse container. Periodically these containers are placed so they can be dumped into a larger container and transported to a land fill or other refuse destination. There are a number of devices for collecting refuse from these relatively small containers. A truck is generally employed, having a large bin into which the containers are emptied. Many vehicles employ compactors which compact the refuse collected in the bins. The refuse is transferred into the bin in a large variety of different ways. The individuals operating the trucks can simply pick up the smaller containers and dump them into the vehicle, or mechanical assemblies can be used to dump the containers into the bin.

Each of these methods have problems associated with them. When the truck operators dump the containers by hand, the size and weight of the containers when full are limited to a size easily handled by an average man. For many households, this requires more than one container, since all of the accumulated refuse may not fit in one of the relatively small containers. Therefore, it takes considerable time to collect the refuse from each stop.

When mechanical devices are used to dump the containers, larger cans may be used requiring only a single transfer of refuse at each stop. However, these mechanical devices, usually consisting of arms which close around the container, are very expensive and require specialized vehicles. Furthermore, while these vehicles may be satisfactory for collecting refuse in rural areas where refuse collection points are widely separated, in urban areas having collection points much closer together, the need to dump each individual load from each collection point into the main bin of a vehicle is inefficient. It generally requires a great deal of time for a collection device to cycle through its entire collection process. A further problem with these collection devices is that only relatively small containers can be dumped. Due to the large volume of refuse, small individual refuse containers would be impractical for industries and large housing complexes. Therefore, large dumpsters are generally used to collect refuse. However, these dumpsters cannot be collected and dumped by the same vehicle which dump the smaller containers. Therefore specialized vehicles, which have hydraulically operated arms capable of engaging the large dumpsters and emptying them in their refuse bin must be used. The vehicle generally loads from the front, since the driver must be able to see the dumpsters in order to engage the dumpsters with the arms. Again, these vehicles are very expensive and specialize in the large dumpsters. This specialization prevents them from collecting and dumping smaller containers.

Therefore, a refuse collection company collecting refuse from large housing complexes such as apartments and from industry as well as from individual homes, would require at least two types of trucks. This can significantly increase the cost of operation.

It would be highly advantageous, therefore, to remedy the foregoing and other deficiencies inherent in the prior art. Accordingly, it is an object of the present invention to provide and new and improved refuse collection device.

Another object of the instant invention is to provide a new method of collecting refuse.

And another object of the present invention is to provide a refuse collection device which will convert a vehicle which normally collects large dumpsters into a vehicle which can collect smaller containers.

Still another object of the present invention is to provide a refuse collection device which would reduce the amount of time required for refuse collection.

Yet another object of the invention is to provide a refuse collection device which would promote more efficient use of equipment.

Yet still another object of the invention is to provide a relatively inexpensive attachment, as opposed to providing a separate vehicle.

A further object of the instant invention is to provide a refuse collection device which facilitates the dumping of heavy garbage containers.

And a further object of the present invention is to provide a new and improved grabber assembly for refuse collection devices.

Yet a further object of the present is to provide a refuse collection device which allows a front end loader to be loaded from the side.

SUMMARY OF THE INVENTION

Briefly, to achieve the desired objects of the instant invention in accordance with the preferred embodiment thereof, provided is an motor powered intermediate container for use with a refuse collection vehicle. The refuse collection vehicle includes a lift device coupled to the refuse collection vehicle for raising said motor powered intermediate container. The motor powered intermediate container includes an intermediate container attachable to the lift device and a sidearm assembly coupled to the intermediate container for emptying refuse into the intermediate container. The side arm assembly includes an extendable arm coupled to the intermediate container and having a terminal end. A tilt assembly for up ending the refuse container so as to empty its contents into the intermediate container is coupled to the terminal end of the extendable arm. A grabber assembly which engages the refuse container is coupled to the tilt assembly.

A method for collecting refuse includes the steps of providing a refuse collection vehicle having a lift device, an intermediate container coupled to the lift device and a sidearm assembly coupled to the intermediate container. The refuse collection vehicle is then positioned adjacent a refuse container and the sidearm assembly is activated to engage the refuse container and empty it into the intermediate container.

BRIEF DESCRIPTION OF THE DRAWINGS

The foregoing and further and more specific objects and advantages of the instant invention will become readily apparent to those skilled in the art from the following detailed description of the preferred embodiment thereof, taken in conjunction with the drawings, in which.

DETAILED DESCRIPTION OF THE PREFERRED EMBODIMENT

Figure 1:
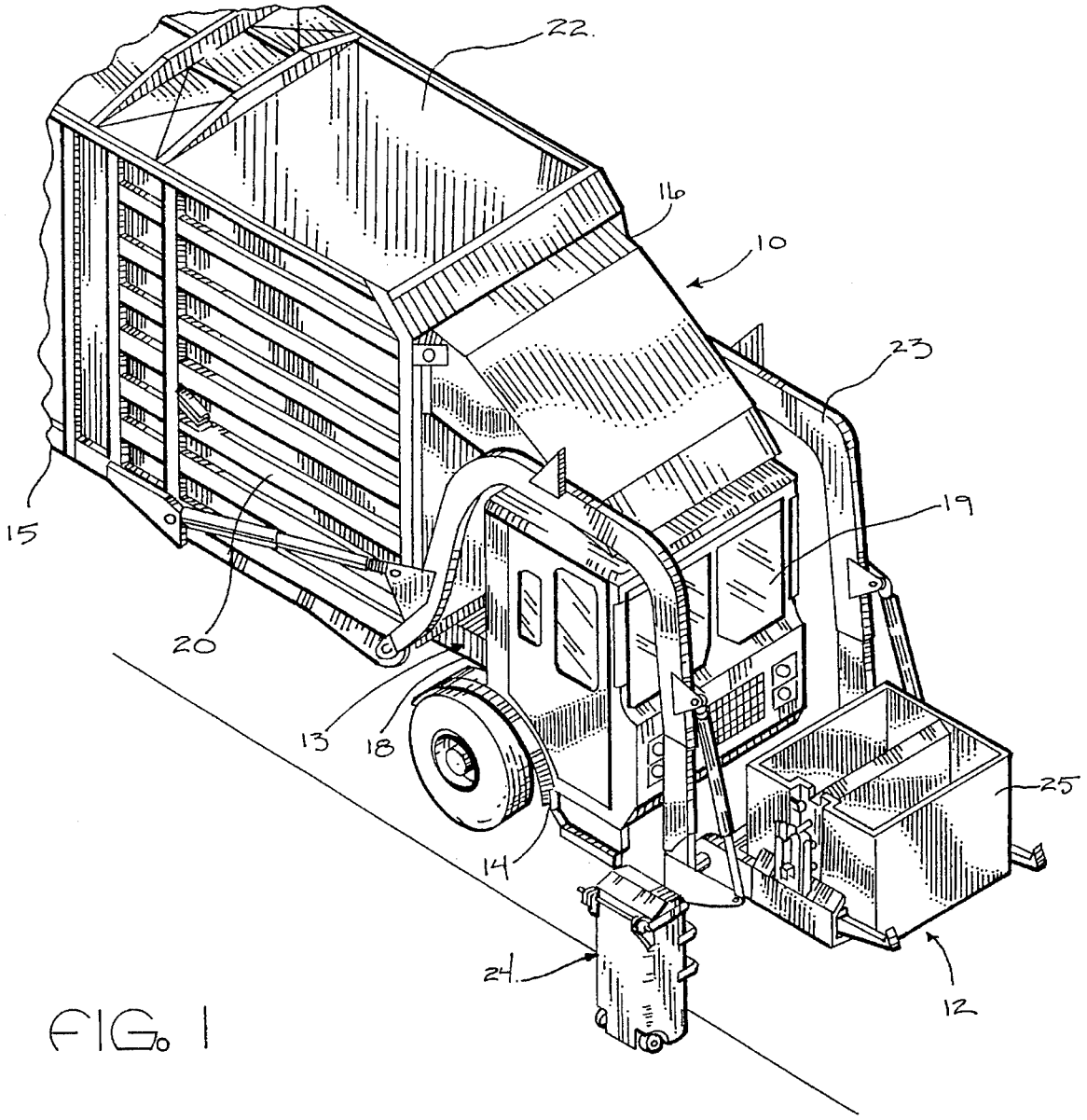
FIG. 1 is a perspective view of a refuse collection vehicle employing a sidearm assembly, constructed in accordance with the teachings of the instant invention, as it would appear immediately prior to engagement with a refuse container.

Turning now to the drawings in which like reference characters indicate corresponding elements throughout the several views, attention is first directed to FIG. 1 which illustrates a refuse collection vehicle generally designated 10 employing an motor powered intermediate container generally designated 12. Refuse collection vehicle 10 includes chassis 13, which, for purposes of orientation throughout the ensuing discussion, is considered to have a forward end 14, a rearward end 15, a left or street side 16, and a right or curb side 18. A cab 19 is carried at forward end 14 of chassis 13. A refuse collection body 20 is carried upon chassis 13 at a generally rearward location. Body 20 is a hollow refuse receiving and storage receptacle. A hopper 22 is integral with the forward portion of body 20. Hopper 22 receives refuse from motor powered intermediate container 12, and may contain a compactor (not shown) to compact the refuse and move it into body 20. However, those skilled in the art will understand that body 20 may simply be an open receptacle. A lift arm 23 pivotally coupled to body 20 and extending forward past cab 19, pivots about a fixed axis. In the lower position free end 21 of lift arm 23 is engageable with motor powered intermediate container 12. In the elevated position, lift arm 23 positions the motor powered intermediate container for dumping into hopper 22.

While FIG. 1 illustrates motor powered intermediate container 12 being used with a refuse collection vehicle 10 having body 20 and forwardly extending lift arms 23, those skilled in the art will understand that other refuse vehicles may be employed. For example, a refuse collection vehicle having a loading mechanism extending from the front back or sides may be used in combination with the motor powered intermediate container. Furthermore, a vehicle without a refuse collection body and only a lifting mechanism may also be used in combination with motor powered intermediate container 12. In this last instance, the vehicle would simply carry an motor powered intermediate container 12 for use as a portable refuse collection unit.

Figure 2:
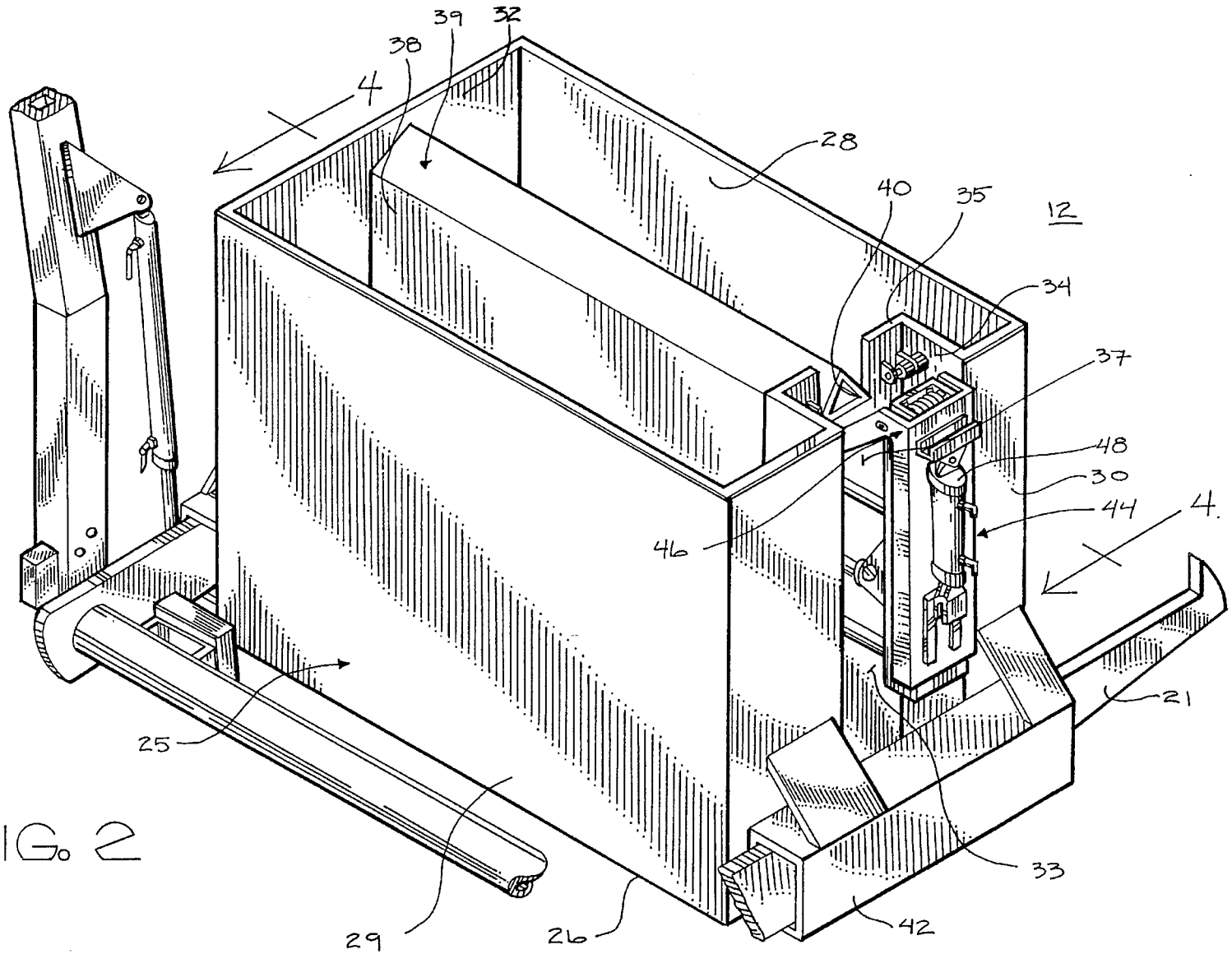
FIG. 2 is a perspective view of an motor powered intermediate container coupled to a lift mechanism.

Referring now to FIG. 2 motor powered intermediate container 12 is illustrated coupled to lift arm 23. Motor powered intermediate container 12 includes an intermediate container 25 having a bottom 26, a forward wall 28, a rearward wall 29, a curb side wall 30 and street side wall 32 forming a generally rectangular container having an open top. A recess 33 is formed in curb side wall 30, and defined by inwardly directed side walls 34 extending perpendicularly inwardly from curb side wall 30. Side walls 34 are joined by a recessed wall 35 recessed inwardly from and parallel to curb side wall 30.

Intermediate container 25 is divided by a pair of parallel spaced apart tunnel walls 38 defining a tunnel 36 therebetween. Tunnel walls 38 extend between recessed wall 35 and street side wall 32 parallel to forward wall 38 and rearward wall 29. The top of tunnel 37 is closed by a tunnel cover 39 having downward sloping sides 40, to prevent collection of refuse thereon.

Attachment members 42 are coupled to curb side wall 30 and street side wall 32 proximate bottom 26 for receiving free ends 21 of lift arm 23. Attachment members 42, in this embodiment, are square tubes extending substantially the width of curb side wall 30 and street side wall 32, and are configured to receive free end 21 of lift arm 23. The configuration of attachment members 42 allows automated intermediate container 12 to be easily attached to and detached from lift arms 23.

Figure 4:
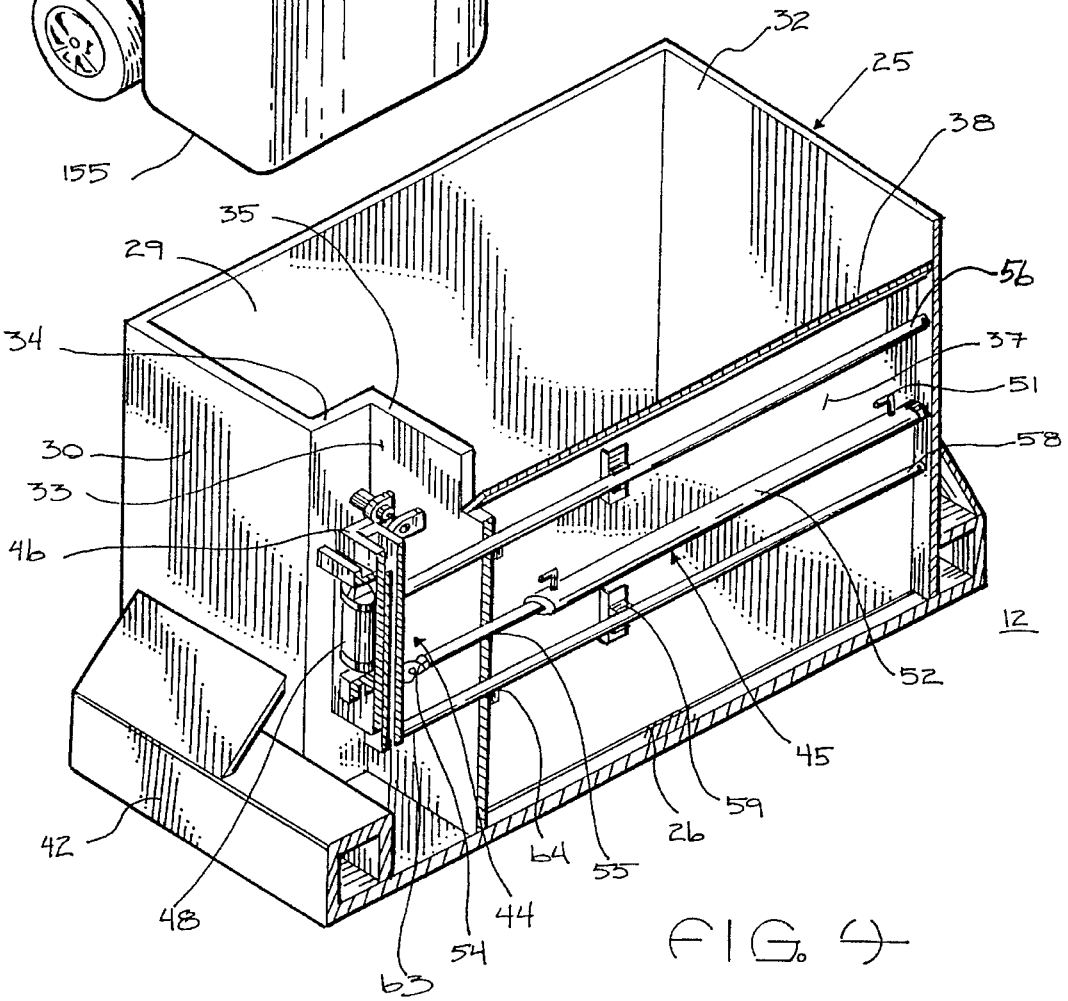
FIG. 4 is a cross sectional side view in perspective, taken along line 4—4 of FIG. 2.

Still referring to FIG. 2, a sidearm assembly generally designated 44 is coupled to intermediate container 25 in recess 33. Sidearm assembly 44 includes an extendable arm 45, a tilt assembly 46, and a grabber assembly 48. With further reference to FIG. 4, extendable arm 45 is an extendable actuator, which in this preferred embodiment is a cylinder assembly 50. Cylinder assembly 50 includes a double acting cylinder 52 coupled to tunnel walls 38 inside tunnel 37, and reciprocally movable operating rod 53 which is extendable or retractable in response to the introduction of pressurized fluid or gas into cylinder 52 through one of intake ports 51 in accordance with conventional practice. Operating rod 53 has a terminal end 54 extending into recess 33 through an opening 55 formed in recessed wall 35. Guide members 56 and 58 are mounted for reciprocal movement corresponding to operating rod 53. Guide members 56 and 58 are slidably mounted to side walls 34 using guides or pillow blocks 59. Guide member 56 is located in tunnel 37 above cylinder assembly 50 and has a terminal end 60 extending through an opening 62 in recessed wall 45. Guide member 58 is mounted below cylinder assembly 50, and has a terminal end 63 which extends into recess 33 through an opening 64 in recessed wall 35.

Figure 5:
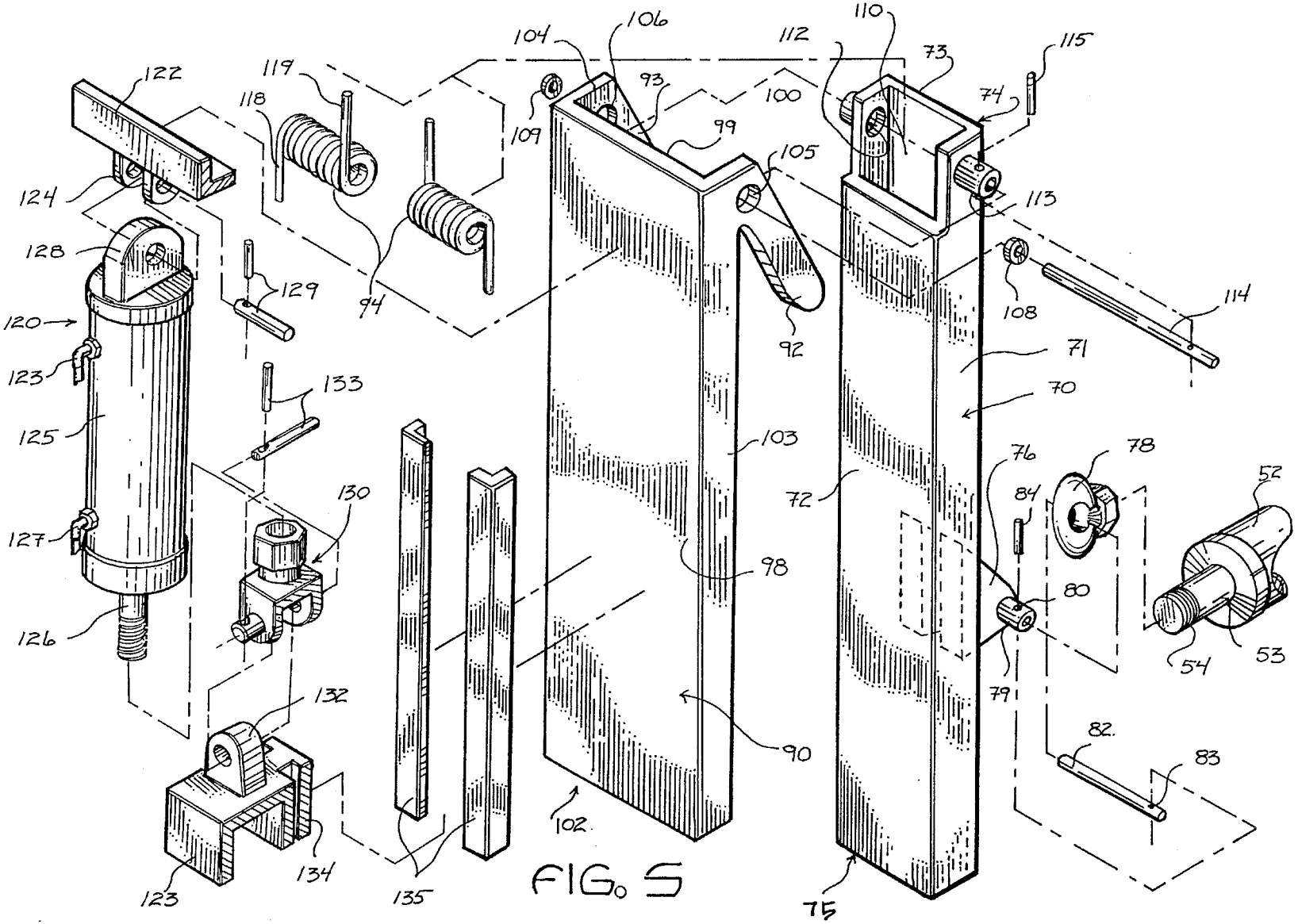
FIG. 5 is an exploded perspective view of the sidearm assembly of the present invention.

Referring now to FIG. 5, an end plate 70, generally configured as a rectangular tube, having sidewalls 71, a front or curb side surface 72, a back or street side surface 73, an upper end 74, and a lower end 75 is coupled to guide members 56 and 58, and to operating rod 53. Terminal end 60 and 63 of guide members 56 and 58 are attached to back surface 73 near upper end 74 and lower end 75 respectively. Terminal end 54 of operating rod 53 is coupled to back surface 73 of end plate 70 between guide members 56 and 58.

It can be seen that a bifurcated bracket 76 extends from back surface 73 of end plate 70 medially between upper end 74 and lower end 75. Terminal end 54 of operating rod 53 has an eye 78 coupled thereto. A collar 79 extends from bifurcated bracket 76, and has a pin hole 80 extending therethrough. Eye 78 is secured in bifurcated brackets 76 by a shaft 82 extending through collar 79, bifurcated bracket 76 and eye 78. A pin hole 83 is formed in shaft 82 concentric with pin hole 80 in collar 79. A pin 84 inserted through pin hole 80 and pin hole 83 retains shaft 82 in bifurcated bracket 76.

A tilt assembly consisting of tilt plate 90 cams 92 and 93, and torsional springs 94 is pivotally coupled to the upper end 74 of end plate 70. Tilt plate 90, in this embodiment, is a channel beam having a front surface 98, a back surface 99, and upper end 100, a lower end 102 and two flanges 103 and 104 extending from back surface 99. Cams 92 and 93 extend outwardly from upper end 100 of flanges 103 and 104 respectively, at a downward angle. Shaft openings 105 and 106, formed at the junction of cams 92 and 93 with flanges 103 and 104 respectively, define the pivot point of tilt plate 90. Friction bearings 108 and 109, which may be bronze bushings, are receivable within shaft openings 105 and 106 respectively.

A recess 100 is formed in upper portion 74 of end plate 70 to house torsional springs 94. A bore 112 is formed through upper end 74 of end plate 70 through side walls 71, with tubular spacers 113 extending bore 112 outwardly from end plate 70. Back surface 99 of tilt plate 90 is placed flushed with front surface 72 of end plate 70, with flanges 103 and 104 overlapping side walls 71 of end plate 70 in a parallel spaced apart relation. Shaft openings 105 and 106 are concentric with bore 112. A shaft 114 is inserted through shaft openings 105 and 106 into bore 112. Shaft 114 also passes through and holds torsional springs 94 in recess 110. A pin 115 extends through tubular spacers 113 and shaft 114 to prevent movement of shaft 114.

Torsional springs 94 include an arm 118 which is anchored against the inner portion of front surface 72, and a spring arm 119 which contacts back surface 99 of tilt plate 90. When spring plate 90 is pivoted about shaft 114, torsional force builds up in torsional spring 94. The release of torsional force when torsional springs 94 relax pivots tilt plate 90 back to its lowered position.

A grabber assembly comprising a spreader actuator, which in this embodiment is a double acting cylinder 120, an upper grabber 122, and a lower grabber 123 is attached to the front surface 98 of tilt plate 90. Upper grabber 122 has an upper surface configured to engage a refuse container which will be described in greater detail below, and a lower surface from which projects a bifurcated mounting bracket 124. Cylinder assembly 120 includes a cylinder 125 and reciprocally movable operating rod 126 which is extendable or retractable in response to the introduction of pressurized fluid or gas to cylinder 125 through one of intake ports 127 in accordance with conventional practice. Cylinder 125 terminates at one end with attachment member 128. Attachment member 128 is secured to bifurcated bracket 124 by shaft and pin assembly 129. Operating rod 126 terminates at the free end with a threadibly attached bifurcated bracket 170. Lower grabber 123 has a first end configured to engage a refuse container, flanges 134 extending from a side adjacent front surface 98, and an opposing end terminating in an attachment member 132 secured to bifurcated bracket 130 by a shaft and pin assembly 133. A slide track 135 is fastened proximate lower end 102 of tilt plate 90. Grabber assembly 48 is attached to front surface 98 of tilt plate 90 by attaching upper grabber 122 to front surface 98 proximate upper end 100 of tilt plate 90, and inserting flanges 134 extending from lower grabber 123 into slide track 135.

Figure 6:
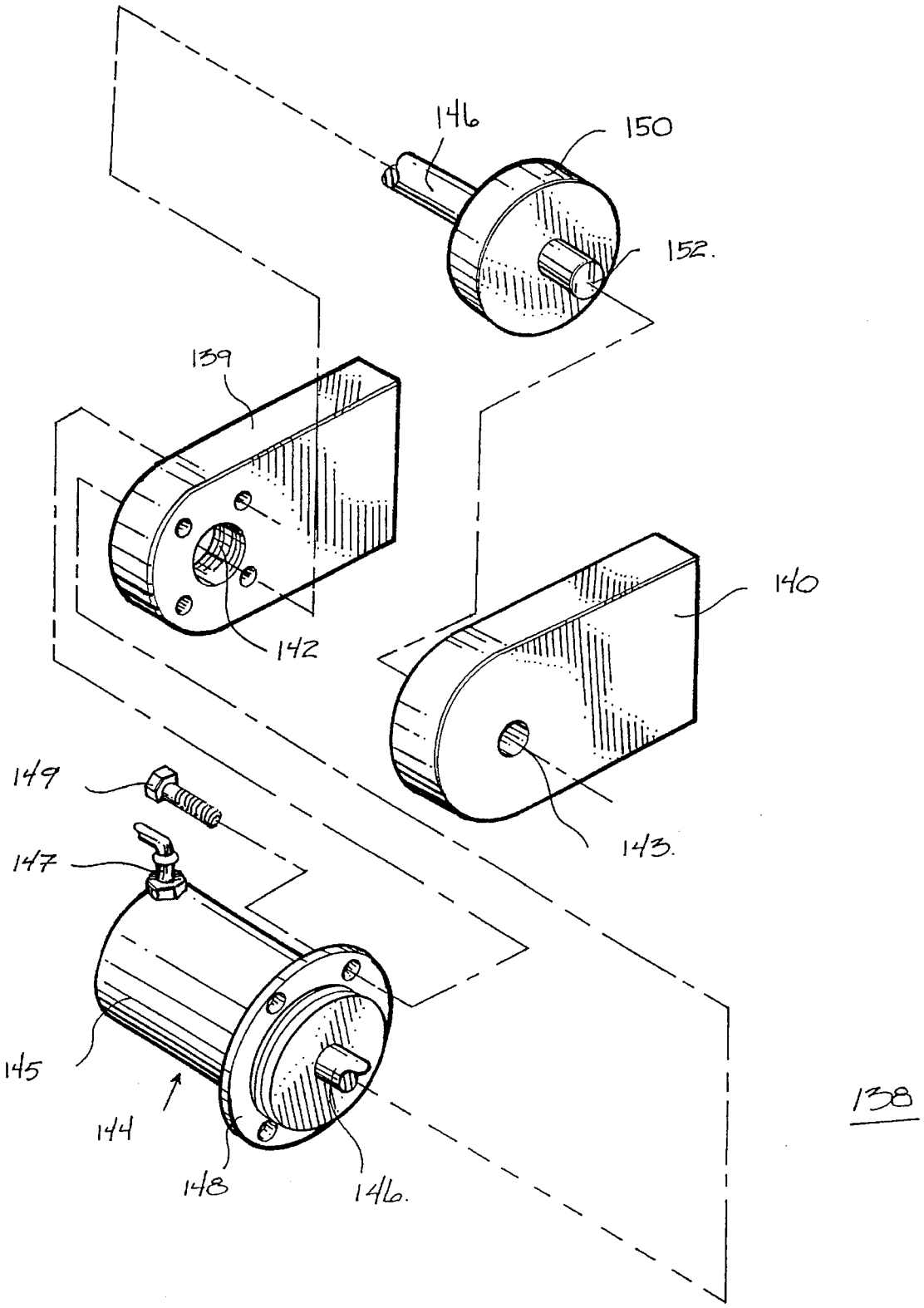
FIG. 6 is an exploded perspective view of a cam follower.

A pair of cam follower assemblies 138 one of which is illustrated in FIG. 6, are coupled to recessed wall 35 of recess 33, one on each side of extendable arm 45. For each cam follower assembly 138, an attachment member 139 and receiving member 140 extend from recess wall 35 in a parallel spaced apart relationship. A bore 142 extends through attachment member 139, and is concentric with a receiving bore 143 extending through receiving member 140. A cylinder assembly 144 is attached to each of attachment members 139. Each cylinder assembly 144 includes single acting cylinder 145 and reciprocating operating rod 146 which is extendable in response to the introduction of pressurized fluid or gas into cylinder 145 through intake port 147 in accordance with conventional practice. Cylinder 145 terminates, at an end from which reciprocating rod 146 extends, with an annular flange 148 secured to attachment member 139 by a set of bolts 149. Reciprocating rod 146 extends from cylinder 145 through bore 142, and carries cam follower 150 proximate its terminal end 152. With cylinder assembly 144 in its retracted position, a space exist between terminal end 152 of reciprocating rod 146. In response to the introduction of a pressurized fluid or gas into cylinder 145, reciprocating rod 146 is extended towards receiving member 140. When fully extended, terminal end 152 of reciprocating rod 46 is received in receiving bore 143. FIG. 6 illustrates a single cam follower assembly 138, however, two cam follower assemblies 138 are employed in the preferred embodiment, with a cam follower assembly 138 located on both sides of extendable arm 45.

It will be understood by those skilled in the art that while motor powered intermediate container 12 is illustrated in combination with a front loading refuse collection vehicle, any vehicle having a lift device may be used. Furthermore, those skilled in the art will understand that sidearm assembly 44 may be mounted in various locations on intermediate container 25. An example would be to mount sidearm assembly 44 on forward wall 28 with tilt assembly 46 and grabber assembly 48 offset towards rearward wall 29 to ensure that refuse container 24 is dumped into intermediate container 25.

Various means for controllably supplying pressurized hydraulic fluid or gas to the various actuating elements for operation of the structure of the instant invention will readily occur to those skilled in the art. The instant invention contemplates using conventional hydraulic systems and controls, which are considered to be apparent to those skilled in the art and therefore omitted so as not to unduly complicate the drawings.

Figure 3:
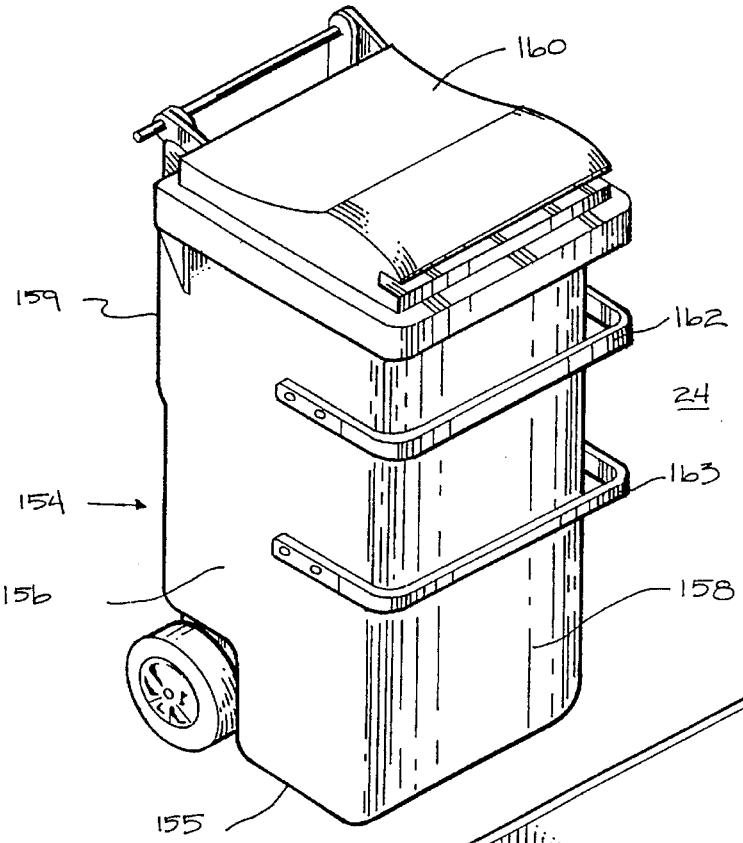
FIG. 3 is a perspective view of a refuse container for use with the motor powered intermediate container.

Referring now to FIG. 3, refuse container 24, for use with motor powered intermediate container 12 is illustrated. Refuse container 24 consists of a body 154 having a bottom 155, side walls 156, a front wall 158, and a back wall 159. A cover 160 is hingedly attached to back wall 159 to close body 154. An upper grab bar 162 and a lower grab bar 163 are fixed to front wall 158 in a parallel spaced apart relationship. Grab bars 162 and 163 extend horizontally across and are outset from front wall 158. Grab bars 162 and 163 are generally placed in the middle of body 154 to approximate a balance point. Upper grab bar 162 and lower grab bar 163 are spaced apart a distance sufficient to permit grabber assembly 48, in its retracted position, to be inserted therebetween.

Figure 7:
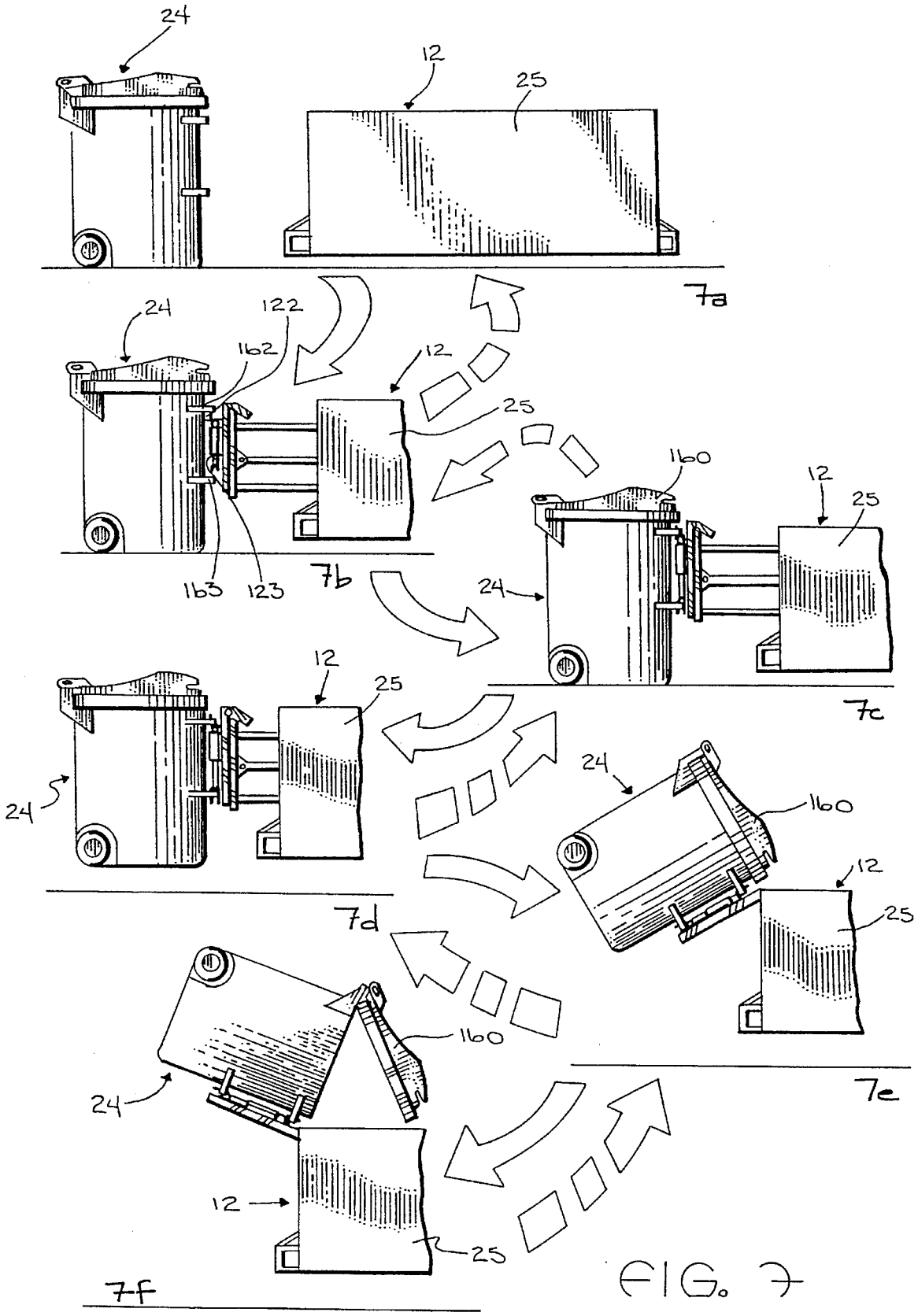
FIG. 7 illustrate the steps involved in engaging and emptying a refuse container into the intermediate container of the present invention.

Referring now to FIG. 7*a*–f, the steps in engaging and emptying refuse container 24 are illustrated. FIG. 7*a* illustrates automated intermediate container 12 positioned adjacent refuse container 24, with sidearm assembly 44 in a retracted position. In its retracted position, sidearm assembly 44 fits into recess 33. Extendable arm 45 is fully retracted, with cams 92 and 93 disengaged from cam followers 150, which are retracted. Motor powered intermediate container 12 is maintained a given distance above the ground by lift arms 23. This allows refuse vehicle 10 to move without damaging motor powered intermediate container 12.

FIG. 7*b* illustrates the extension of extendable arm 45 by activating cylinder assembly 50 which extends operating rod 53. Extendable arm 45 is extended until grabber assembly 48 is positioned between upper grab bar 162 and lower grab bar 163. Lift arms 23 are then raised a distance sufficient to engage upper grabber 122 with upper grab bar 162. Referring now to FIG. 7*c*, cylinder assembly 120 is activated, extending operating rod 126. This engages lower grabber 123 to lower grab bar 163. The spreading of upper grabber 122 and lower grabber 123 securely attaches refuse container 24 to sidearm assembly 44.

Motor powered intermediate container 12 is then raised by raising lift arms 23, lifting refuse container 24 from the ground as illustrated in FIG. 70. When refuse container 24 has been lifted, extendable arm 45 is retracted by activating cylinder 52 and retracting operating rod 53. This draws refuse container 24 towards intermediate container 25. When extendable arm 45 is being retracted, cam followers 150 are placed in position to engage cams 92 and 93. This is accomplished by activating cylinder 145 causing rod 146 to extend and be received by receiving bore 143 of receiving member 140.

Referring now FIG. 7*e*, extendable arm 45 is retracted until cams 92 and 93 contact cam followers 150. As extendable arm 45 continues to retract, cam followers 150 force cams 92 and 93 downward, swinging tilt plate 90 with attached refuse container 24 upward. When tilt plate 90 reaches the proper elevation, cover 160 of refuse container 24 swings open allowing refuse to empty from body 154. When tilt plate 90 swings upward, a torsional force is build up in torsional spring 94. To lower the refuse container 24, extendable arm 45 is again extended allowing cams 92 and 93 to disengage from cam followers 150. The relaxing of torsional spring 94 assist gravity in lowering tilt plate 90. Refuse container 24 is then replaced adjacent motor powered intermediate container 12 by the reversal of steps 7*a* through 7*f* as discussed above.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An motor powered intermediate container in combination with a refuse collection vehicle, wherein said refuse collection vehicle includes forwardly extending arms suitable for engaging, lifting and emptying directly into said vehicle a front loader refuse container filled with refuse, said motor powered intermediate container comprising:

an intermediate container carried by said forwardly extending arms; said intermediate container having support means for supporting said intermediate container on said forwardly extending arms;

an assembly extendable to the curb side of the vehicle and carried by said intermediate container;

said assembly having motor powered means including a dumping assembly and an extendable element carrying an engagement assembly;

said dumping assembly having motor powered means to empty the contents of a curb side refuse container into said intermediate container;

said engagement assembly having motor powered means to hold the refuse container during the emptying operation; and said extendable element having motor powered means to extend said extendable element and said engagement assembly into engagement with the refuse container, whereby the use of said motor powered intermediate container converts said refuse collection vehicle from collection by lifting front loader refuse containers and emptying them directly into said vehicle to collection by collecting from curb side refuse containers to said intermediate container carried by said forwardly extending arms.

2. A motor powered intermediate container as claimed in claim 1 wherein said extendable assembly further comprises:

an extendable element coupled to an intermediate container and having a terminal end;

said dumping assembly having a tilt assembly coupled to said terminal end; and said engagement assembly having a grabber assembly coupled to said tilt assembly.

3. A motor powered intermediate container as claimed in claim 2 wherein said extendable element further comprises an extendable actuator device and guide members coupled to said intermediate container and said terminal end.

4. A motor powered intermediate container as claimed in claim 3 wherein said terminal end is an end plate.

5. A motor powered intermediate container as claimed in claim 2 wherein said tilt assembly further comprises:

a tilt member pivotally coupled to said extendable element end; and a tilting mechanism attached to said tilt member.

6. A motor powered intermediate container as claimed in claim 5 wherein said tilt mechanism includes a cam and cam follower, one of said cam and cam follower being attached to said tilt mechanism, and the other of said cam and cam follower being attached to said intermediate container.

7. A motor powered intermediate container as claimed in claim 2 wherein said grabber assembly further comprises:

a first grabber;

a second grabber; and a spreader actuator spreadably coupling said first grabber to said second grabber.

8. A motor powered intermediate container as claimed in claim 7 wherein said spreader actuator is a hydraulic cylinder.

9. A motor powered intermediate container as claimed in claim 2 wherein said intermediate container has an attachment member for removably receiving said lift mechanism of said refuse collection vehicle.

* * * * *